US005864227A

United States Patent [19]

Borden et al.

[11] Patent Number: 5,864,227

[45] Date of Patent: Jan. 26, 1999

[54] VOLTAGE REGULATOR WITH OUTPUT PULL-DOWN CIRCUIT

[75] Inventors: Robert B. Borden, Plano, Tex.; Mark Pulkin, Lilburn, Ga.

[73] Assignee: Texas Instruments Incorporated, Dallas, Tex.

[21] Appl. No.: 41,146

[22] Filed: Mar. 12, 1998

Related U.S. Application Data

[60] Provisional application No. 60/040,183, Mar. 12, 1997.

[51] Int. Cl.[6] ..... G05F 1/40

[52] U.S. Cl. ..... 323/280

[58] Field of Search ..... 323/280, 274, 323/275

[56] References Cited

U.S. PATENT DOCUMENTS

| | | | |
|---|---|---|---|
| 4,536,699 | 8/1985 | Baker | 323/276 |
| 5,548,205 | 8/1996 | Monticelli | 323/274 |
| 5,648,718 | 7/1997 | Edwards | 323/274 |

*Primary Examiner*—Shawn Riley
*Attorney, Agent, or Firm*—Alan K. Stewart; Wade James Brady III; Richard L. Donaldson

[57] ABSTRACT

A voltage regulator circuit includes: an output transistor $MP_X$ coupled between a voltage supply node $V_{CC}$ and an output node $V_{OUT}$; an amplifier $A_1$ coupled to the output transistor $MP_X$ for controlling the response of the output transistor $MP_X$; feedback circuitry $R_1$ and $R_2$ connected between the output node $V_{OUT}$ and the amplifier $A_1$, the feedback circuitry $R_1$ and $R_2$ providing feedback to the amplifier $A_1$; and a pull-down circuit $PD_1$ coupled to the output node $V_{OUT}$.

8 Claims, 1 Drawing Sheet

FIG. 1
(PRIOR ART)
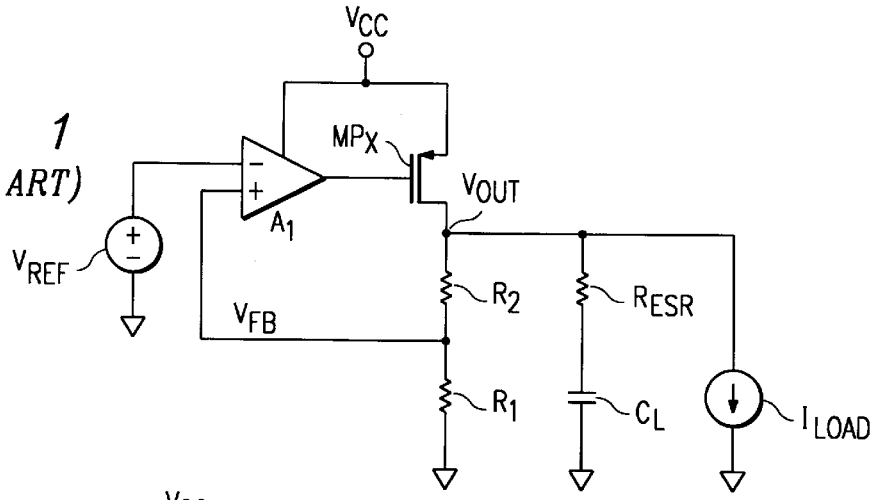
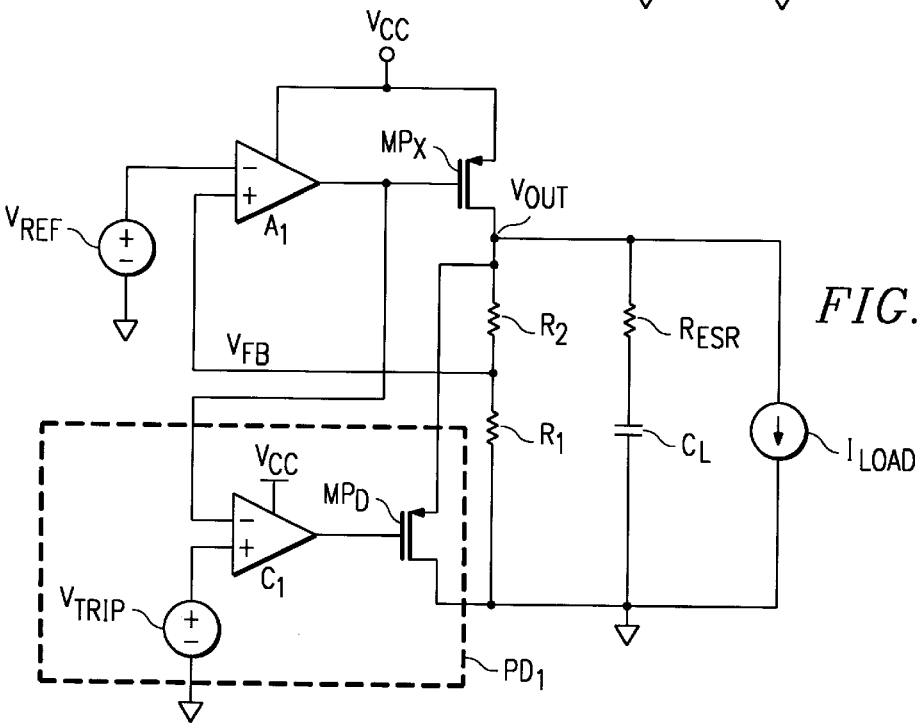
FIG. 2
FIG. 3
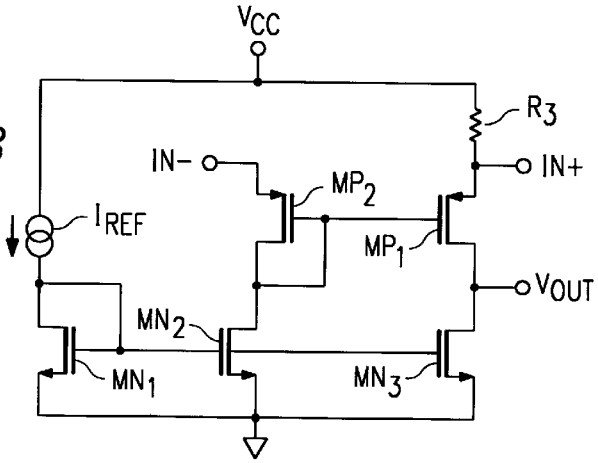

VOLTAGE REGULATOR WITH OUTPUT PULL-DOWN CIRCUIT

This application claims priority under 35 USC § 119 (e) (1) of provisional application number 60/040,183, filed Mar. 12, 1997.

FIELD OF THE INVENTION

This invention generally relates to electronic systems and in particular it relates to low dropout voltage regulators.

BACKGROUND OF THE INVENTION

When the output current of a prior art low dropout (LDO), PMOS voltage regulator, as shown in FIG. 1, is changed rapidly, large transient output voltages can be induced at the regulator output. Usually the regulator can compensate for these transients and the output voltage can quickly recover before the transient voltages create problems in the system. However, in the case when a very large current load (hundreds of milliamps to several amps) is rapidly removed from a regulator, the output voltage can rise to dangerously high levels and remain high for a long period of time before returning to regulation. This high output voltage condition results when the output load current changes more rapidly than the amplifier can respond. For the period of time between the removal of the output current load and the appropriate response of the amplifier (the response time), the output voltage loses regulation. The gate of the output PMOS is still being held at a voltage level that can supply large currents to the load, but the load has been removed. The current that was previously going to the load begins charging the external load capacitor, $C_L$, during the response time which forces the output voltage to rise. Once the amplifier has correctly responded to the change in the load current the output voltage of the amplifier is high enough to cut-off the output PMOS. With the output PMOS cut-off and the load current removed, the only current path available to discharge the high output voltage on $C_L$ is through the feedback resistors, $R_1$ and $R_2$. These resistors are usually high-valued resistors (to minimize the quiescent current of the regulator), and are only able to sink a few microamps of current. With only the resistor current available to discharge the load capacitor it can take hundreds of milliseconds for the regulator to return to regulation. The recovery time of the regulator can be improved by decreasing the size of the feedback resistors. However, to be effective, this solution requires decreasing the resistor values to the point where the quiescent current of the regulator becomes excessive.

SUMMARY OF THE INVENTION

Generally, and in one form of the invention, the voltage regulator circuit includes: an output transistor coupled between a voltage supply node and an output node; an amplifier coupled to the output transistor for controlling the response of the output transistor; feedback circuitry connected between the output node and the amplifier, the feedback circuitry providing feedback to the amplifier; and a pull-down circuit coupled to the output node.

BRIEF DESCRIPTION OF THE DRAWINGS

In the drawings:

FIG. 1 is a schematic circuit diagram of a prior art low dropout, PMOS voltage regulator;

FIG. 2 is a schematic circuit diagram of a preferred embodiment low current, low dropout voltage regulator with voltage recovery circuit;

FIG. 3 is a schematic circuit diagram of the comparator shown in FIG. 2.

DETAILED DESCRIPTION OF PREFERRED EMBODIMENTS

The prior art voltage regulator circuit of FIG. 1 includes amplifier $A_1$; output PMOS transistor $MP_X$; load capacitance $C_L$; feedback resistors $R_1$ and $R_2$; resistance $R_{ESR}$ ($R_{ESR}$ is the equivalent series resistance of load capacitance $C_L$); source voltage $V_{CC}$; reference voltage $V_{REF}$; load current $I_{LOAD}$; output voltage $V_{OUT}$; and feedback voltage $V_{FB}$. FIG. 2 is a circuit schematic illustrating a preferred embodiment low current LDO output voltage recovery circuit constructed according to the teachings of the present invention. The circuit of FIG. 2 includes amplifier $A_1$; comparator $C_1$; PMOS transistors $MP_X$ and $MP_D$; capacitor $C_L$; feedback resistors $R_1$ and $R_2$ (feedback circuitry); resistance $R_{ESR}$; source voltage $V_{CC}$; reference voltage $V_{REF}$; trip voltage $V_{TRIP}$; load current $I_{LOAD}$; output voltage $V_{OUT}$; and feedback voltage $V_{FB}$.

The preferred embodiment circuit of FIG. 2 adds a pull-down circuit $PD_1$ to the prior art circuit of FIG. 1. The pull-down circuit $PD_1$ includes comparator $C_1$, trip voltage $V_{TRIP}$, and pull-down transistor $MP_D$. The comparator $C_1$ is used to detect the output over-voltage condition and transistor $MP_D$ adds an internal current load to the output of the regulator while the over-voltage condition exists. The over-voltage condition can be detected by monitoring the output voltage of the amplifier $A_1$ in the following manner. When there is no output current load placed on the regulator, the output voltage of the amplifier $A_1$ is at voltage $V_{a0}$. However, when an over-voltage condition exists because of the change in the load current $I_{LOAD}$ described above, the output voltage of the amplifier $A_1$ rises to the maximum output voltage of the amplifier $V_{a(max)}$. The difference between the two voltages $V_{a0}$ and $V_{a(max)}$ is approximately one volt which allows enough margin to accurately detect the over-voltage condition over process and temperature variations.

The schematic of the comparator $C_1$ is shown in FIG. 3. The comparator circuit of FIG. 3 includes PMOS transistors $MP_1$ and $MP_2$; NMOS transistors $MN_1$, $MN_2$, and $MN_3$, reference current $I_{ref}$; resistor $R_3$; supply voltage $V_{CC}$; inverting comparator input IN−; non-inverting comparator input IN+; and comparator output $V_{CO}$. The trip point of the comparator $C_1$ is set by the resistor $R_3$, and the current $I_{ref}$ in the following manner:

$$V_{trip}=V_{CC}-I_{ref}*R_1$$

Using this equation, $V_{trip}$ is set 200 mV below $V_{a(max)}$.

The comparator works in the following manner. Under normal operating conditions the voltage on IN−, which monitors the output of the amplifier $A_1$, is lower than the trip voltage $V_{trip}$ of the comparator $C_1$. This forces a large $V_{gs}$ voltage on transistor $MP_1$ which enters the linear region of operation and the output voltage of the comparator $C_1$ rises to $V_{trip}$. With the output of the comparator $C_1$ high, transistor $MP_D$ in FIG. 2 is cut-off and no current is pulled from the output of the regulator. When an over-voltage condition exists due to the load current $I_{LOAD}$ of the regulator changing rapidly from a large value to near zero, the output voltage of the amplifier $A_1$ rises above $V_{trip}$ which cuts off transistor $MP_1$ and forces the output voltage of the comparator $C_1$ to drop to virtual ground. When the output of the comparator $C_1$ falls to ground, transistor $MP_D$ is forced into the linear region and pulls several milliamps of current from the output of the regulator, and returns the output voltage of the regulator back into regulation in a matter of a few milliseconds. Once the output voltage achieves regulation, the output of comparator $C_1$ goes high and turns off transistor $MP_D$, returning the regulator back to normal operation.

Although the present invention has been described in detail, it should be understood that various changes, substitutions and alterations can be made without departing from the spirit and scope of the invention as defined by the appended claims. It is therefore intended that the appended claims encompass any such modifications or embodiments.

What is claimed is:

1. A voltage regulator circuit comprising:

an output transistor coupled between a voltage supply node and an output node;

an amplifier coupled to the output transistor for controlling the response of the output transistor;

feedback circuitry connected between the output node and the amplifier, the feedback circuitry providing feedback to the amplifier;

a pull-down transistor coupled to the output node; and a comparator coupled to the pull-down transistor for controlling the response of the pull-down transistor, a first input of the comparator is coupled to an output of the amplifier and a second input of the comparator is coupled to a reference node.

2. The circuit of claim 1, wherein the feedback circuitry includes a first resistor and a second resistor connected in series, the output transistor is coupled to a first end of the first resistor, a second end of the first resistor is coupled to a first end of the second resistor, and the amplifier is coupled to the first end of the second resistor.

3. The circuit of claim 1, further comprising a reference voltage source coupled to the amplifier.

4. A voltage regulator circuit comprising:

an output MOS transistor having a gate, a source, and a drain;

an amplifier coupled to the gate of the MOS transistor;

feedback circuitry coupled to the drain of the MOS transistor;

a feedback line coupling the feedback circuitry to a first input of the amplifier;

a reference voltage source coupled to a second input of the amplifier;

a supply voltage coupled to the source of the MOS transistor;

a pull-down MOS transistor coupled to the output node; and a comparator coupled to the pull-down MOS transistor for controlling the response of the pull-down MOS transistor, a first input of the comparator is coupled to an output of the amplifier and a second input of the comparator is coupled to a trip voltage node.

5. The circuit of claim 4 wherein the output MOS transistor is a PMOS transistor.

6. The circuit of claim 4 wherein the pull-down MOS transistor is a PMOS transistor.

7. The circuit of claim 4, wherein the feedback circuitry includes a first resistor and a second resistor connected in series.

8. The circuit of claim 7, wherein the drain of the output MOS transistor is coupled to a first end of the first resistor, a second end of the first resistor is coupled to a first end of the second resistor, and the feedback line is coupled to the first end of the second resistor.

* * * * *